US005143252A

United States Patent [19]

Shi

[11] Patent Number: 5,143,252

[45] Date of Patent: Sep. 1, 1992

[54] PORTABLE PACKAGE AND SYSTEM FOR STORING AND DISPENSING PHOTOGRAPHIC FILM CARTRIDGES

[76] Inventor: Zhimin Shi, 25-17 39th Ave., Long Island City, N.Y. 11101

[21] Appl. No.: 609,271

[22] Filed: Nov. 5, 1990

[51] Int. Cl.[5] ..... B65G 59/00

[52] U.S. Cl. ..... 221/185; 221/287; 221/303; 221/306; 206/818; 224/908

[58] Field of Search ..... 221/197, 185, 287, 303, 221/305-307, 309, 312 R; 312/45, 72, 73; 224/908, 183, 236, 239, 240, 241; 206/818, 3

[56] References Cited

U.S. PATENT DOCUMENTS 1,753,957 4/1930 Washburn ..... 221/287
1,898,056 2/1933 Johnson ..... 221/309
3,157,445 11/1964 Aversa ..... 312/45
3,265,246 8/1966 Messenger ..... 221/287
4,180,192 12/1979 Breslau ..... 221/185
4,331,335 5/1982 Starkweather ..... 206/818

FOREIGN PATENT DOCUMENTS 967105 10/1950 France ..... 312/45

*Primary Examiner*—H. Grant Skaggs
*Attorney, Agent, or Firm*—Pennie & Edmonds

[57] ABSTRACT

A portable package for storing and dispensing photographic film cartridges is constructed by a package of film cartridges and a housing of the package. The package contains two or more cartridges in it. Both the package and the housing have matching outlets for dispensing the cartridges.

5 Claims, 2 Drawing Sheets

PORTABLE PACKAGE AND SYSTEM FOR STORING AND DISPENSING PHOTOGRAPHIC FILM CARTRIDGES

BACKGROUND OF THE INVENTION

1. Technical Field

The present invention relates to a portable package for storing and dispensing photographic film cartridges. More particularly, the invention relates to a container which comprises a package of said film cartridges and a housing for the package.

2. Background Art

Photographic film cartridges, such as those utilized in 35 mm cameras, are commonly sold either individually or in packages of multiple cartridges, e.g., three to five film cartridges. The unit price film of cartridges sold in packages is usually less than that of cartridges sold individually.

For those who are accustomed to using a multiplicity of film cartridges during the course of a photo shooting session or assignment, for example, advanced amateur or professional photographers, it is often inconvenient to store unused and used cartridges and to select one prior to loading it in the camera.

Therefore, a need exists for an innovative means of conveniently storing film cartridges, and dispensing them one-by-one.

It is an object of the present invention to provide a novel container or packaging system for storing and dispensing photographic film cartridges.

Another object is to provide a novel housing for photo film cartridge packages in such a container or packaging system.

These and other objects of the invention as well as the advantages thereof can be had by reference to the following description and claims.

SUMMARY OF THE INVENTION

The foregoing objects are achieved according to the present invention, one aspect of which is a container for photographic film cartridges for use in storing and dispensing said cartridges. The package of cartridges is inserted into a housing for the package to provide the container.

The package is constructed of four vertical walls, a bottom, a top, and an outlet from which the cartridges can be dispensed. The package contains a plurality of film cartridges. The package can be converted from a film pack sold on the market which is usually made of cardboard. The outlet allows the cartridge to be dispensed. The cut end of the outlet on one wall is just larger than the size of the film cartridge either in a endways manner or a sideways manner. The cut end of the side walls may be big enough so that an individual cartridge can be withdrawn from the package by using the fingers. To protect the cartridge from dropping out from the package, the outlet is preferably located slightly above the bottom.

The housing is constructed of four vertical walls, a bottom, an open top (into which used cartridges can be inserted for storage), an outlet for the cartridges, and at least one means for holding the cartridges in the package. The housing can be made of any rigid material, such as metal or plastic. The dimensions of the horizontal cross-section of the housing are slightly larger than that of the package in order to enable the package to be fitted into the housing. The height of the housing can be determined optionally, and is preferably about a half as long as that of the package. The outlet of the housing must correspond to the outlet of the package.

In order to hold the cartridge in the package more securely, one way is to dispense cartridge in a sideways manner, i.e., the outlet is located slightly above the bottom, as shown in FIGS. 1, 2 and 3 of the accompanying drawings. Another way is by means of a slideable stopper as shown in FIGS. 4, 5 and 6 of the drawings. Also, at least one magnet can be provided inside the walls of the housing adjacent to the outlet.

The container may be further equipped with a kind of clasp to make the container portable, e.g. by enabling the housing to be worn on the photographer's belt.

BRIEF DESCRIPTION OF THE DRAWINGS

Referring to the drawings.

DESCRIPTION OF PREFERRED EMBODIMENTS

Example 1

Figure 1:
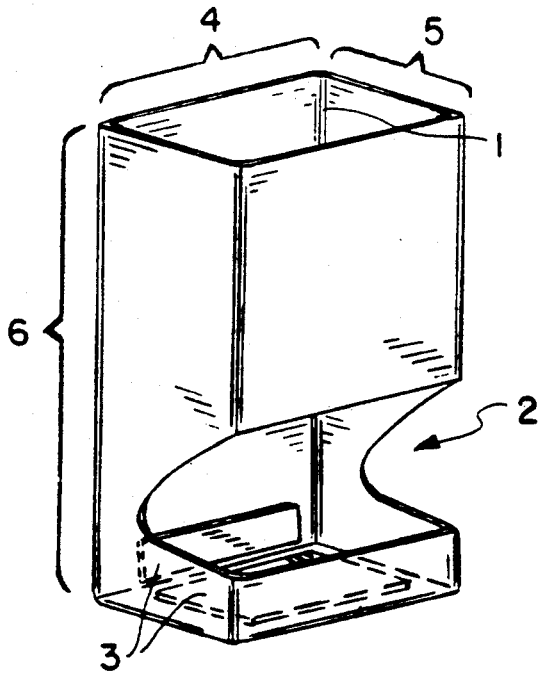
FIG. 1 is an elevational view in perspective of a housing of a package according to the invention.
Figure 2:
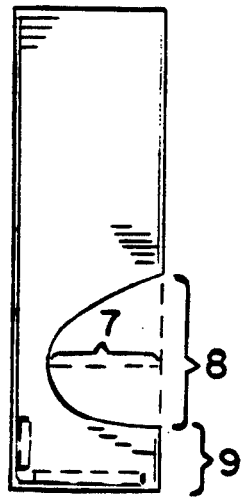
FIG. 2 is a side view of the housing shown in FIG. 1.

Referring to FIG. 1, a representative housing 1 of a film package comprises four side walls, an open top, a bottom, an outlet 2 and two magnets 3. Standard dimensions of the housing of width 4, depth 5 and height 6 are $2'' \times 1\frac{1}{2}'' \times 4''$. The dimensions 4, 7, and 8 of the outlet are $2'' \times 1'' \times 1\frac{1}{4}''$, respectively, referring to FIG. 2. The bottom 9 of the outlet 2 is $\frac{1}{2}''$ above the bottom of the housing.

Figure 3:
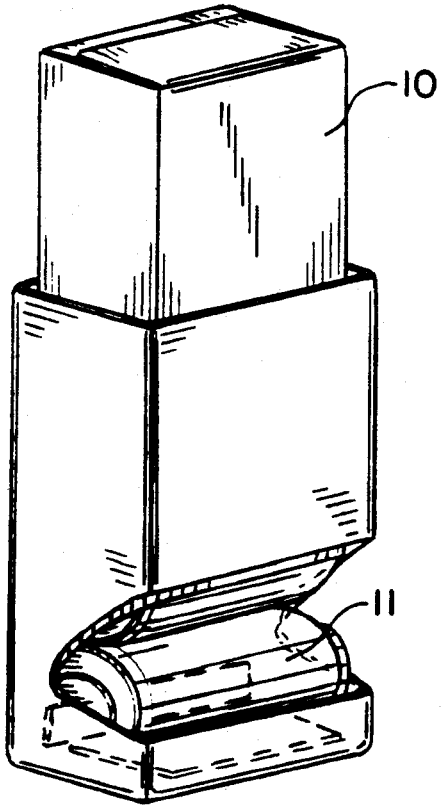
FIG. 3 is an elevational view in perspective of a container according to the invention which comprises a package with 35 mm photographic film cartridges and a housing shown in FIG. 1.

A package 10 containing 35 mm film cartridges 11 is inserted into the housing 1 to provide a container, or packaging system as shown in FIG. 3.

Example 2

Figure 4:
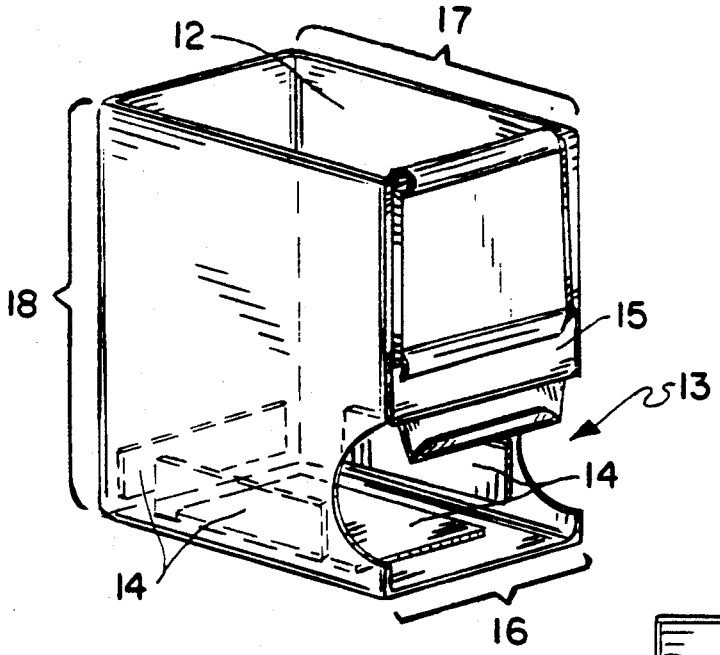
FIG. 4 is a side view of a housing shown in FIG. 4.
Figure 5:
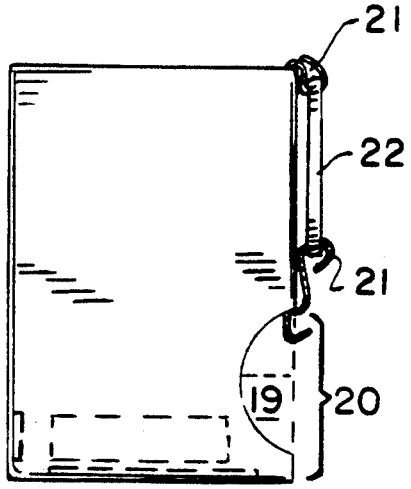
FIG. 5 is a side view of a housing shown in FIG. 4.

Referring to FIG. 4, a housing 12 for a package film cartridge comprises four side walls, an open top, a bottom, an outlet 13, four magnets 14 and a slidable stopper 15. The dimensions 16, 17, and 18 of the housing and the dimensions 16, 19 and 20 of the outlet are $1\frac{1}{2}'' \times 2\frac{1}{2}'' \times 3\frac{1}{2}''$, and $1\frac{1}{2}'' \times \frac{1}{2}'' \times 1\frac{1}{2}''$, respectively. The stopper 15 is constructed of two rubber bands 22 which are used to connect the metal hooks 21.

Figure 6:
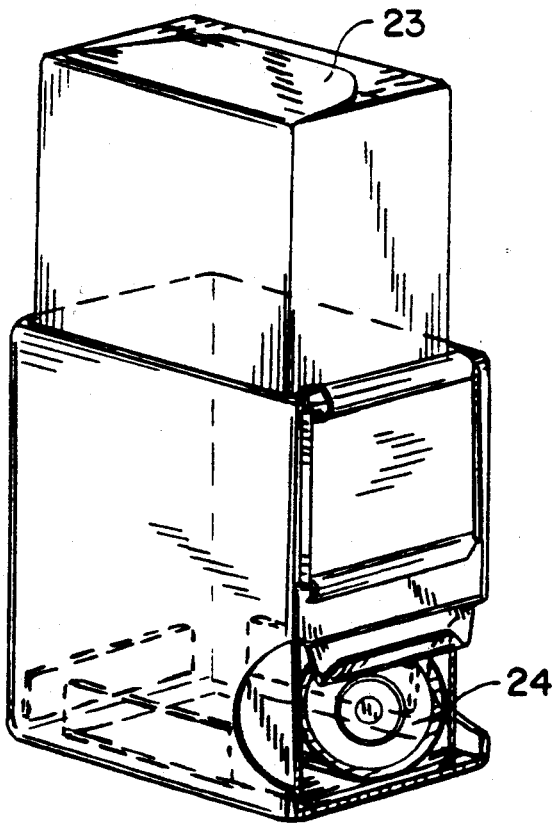
FIG. 6 is an elevational view in perspective of a container according to the invention which comprises a package with 35 mm photographic film cartridges and a housing shown in FIG. 4.

A package 23 with 35 mm film cartridges 24 is inserted into the housing to provide a container system as shown in FIG. 6.

The foregoing description is intended to illustrate the invention, and it is understood that changes and variations can be made in the foregoing embodiments without departing from the spirit and scope of the invention which is defined in the following claims.

I claim:

1. A container for use in storing and dispensing photographic film cartridges, comprising:

a package of film cartridges, said package having four walls, a bottom, a top and an outlet which extends across one wall and into each of the adjacent walls to allow the cartridges to be dispensed, said outlet being located above the bottom of the package to prevent the cartridges from dropping out of the package; and a housing for the package, said housing having four walls, a bottom, an open top into which the package can be inserted, an outlet which corresponds to the outlet on the package, and at least one magnet adjacent to the outlet for holding the cartridges in the package.

2. The contained according to claim 1 wherein the housing is further equipped with a clasp to enable the container to be worn on the photographer's belt.

3. A container for use in storing and dispensing photographic film cartridges, comprising a package of film cartridges, said package having four walls, a bottom, a top and an outlet which extends along the bottom across one wall and into each of the adjacent walls to allow the cartridge to be dispensed; and a housing for the package, said housing having four walls, a bottom, an open top into which the package can be inserted, an outlet which corresponds to the outlet on the package, at least one magnet adjacent to the outlet for holding the cartridges in the package, and a stopper means to prevent the cartridges from dropping out of the outlet.

4. The container according to claim 3, wherein the stopper means is a slideable door.

5. The container according to claim 3, wherein the housing is further equipped with a clasp to enable the container to be worn on the photographer's belt.

* * * * *